US012318676B2

(12) United States Patent
Costabile

(10) Patent No.: US 12,318,676 B2
(45) Date of Patent: Jun. 3, 2025

(54) SYSTEM AND METHOD FOR COLLECTING DATA IN A LIVE SPORTING EVENT

(71) Applicant: Michael Joseph Costabile, Oak Island, NC (US)

(72) Inventor: Michael Joseph Costabile, Oak Island, NC (US)

(73) Assignee: Right Time Sports, LLC, Supply, NC (US)

( * ) Notice: Subject to any disclaimer, the term of this patent is extended or adjusted under 35 U.S.C. 154(b) by 287 days.

(21) Appl. No.: 17/910,375

(22) PCT Filed: Apr. 8, 2020

(86) PCT No.: PCT/US2020/027135
§ 371 (c)(1),
(2) Date: Sep. 9, 2022

(87) PCT Pub. No.: WO2021/206698
PCT Pub. Date: Oct. 14, 2021

(65) Prior Publication Data

US 2023/0135543 A1 May 4, 2023

(51) Int. Cl.
*A63B 71/06* (2006.01)

(52) U.S. Cl.
CPC ..... *A63B 71/0605* (2013.01); *A63B 2220/62* (2013.01); *A63B 2220/808* (2013.01); *A63B 2220/833* (2013.01); *A63B 2225/20* (2013.01); *A63B 2225/50* (2013.01); *A63B 2243/0037* (2013.01)

(58) Field of Classification Search
CPC ..... A63B 71/0605; A63B 2220/62; A63B 2220/808; A63B 2220/833; A63B 2225/20; A63B 2225/50; A63B 2243/0037; G07C 1/22; G07C 1/28
See application file for complete search history.

(56) References Cited

U.S. PATENT DOCUMENTS

| | | | | |
|---|---|---|---|---|
| 5,065,251 | A * | 11/1991 | Shuhart, Jr. | H04N 5/76 386/E5.001 |
| 10,504,300 | B2 * | 12/2019 | Costabile | G07C 1/28 |
| 10,798,468 | B2 * | 10/2020 | Bokowski | H04N 21/4312 |
| 11,413,514 | B2 * | 8/2022 | Marty | A63B 24/0021 |
| 2005/0240872 | A1 * | 10/2005 | Roeske | A63B 71/06 725/39 |

(Continued)

FOREIGN PATENT DOCUMENTS

| | | |
|---|---|---|
| WO | WO 00/73858 | 12/2000 |

*Primary Examiner* — Masud Ahmed
(74) *Attorney, Agent, or Firm* — Dilworth & Barrese, LLP.

(57) ABSTRACT

A system and method of collecting data in a live sporting event includes a set of components used at a sporting event, for example a basketball game. Those components can include referee communication bundles, hoop sensors and a time clock, all communicatively coupled through a central base station. Multiple base stations at different locations, for example other basketball games, are communicatively coupled to a database that can be accessed remotely via a digital device having the appropriate application. A variety of data generated during a game, including environmental, biometrics of referees and game-related, are directed to and stored on the database for real time analysis and adjustments where appropriate, or for later review and analysis.

13 Claims, 3 Drawing Sheets

(56) References Cited

U.S. PATENT DOCUMENTS

| | | | | |
|---|---|---|---|---|
| 2010/0085167 | A1* | 4/2010 | Costabile | A63B 71/0669 340/323 R |
| 2017/0186414 | A1* | 6/2017 | Ellingson | G08B 7/06 |
| 2018/0204391 | A1* | 7/2018 | Costabile | G07C 1/22 |
| 2019/0099648 | A1* | 4/2019 | Boatright | A63B 71/0622 |
| 2019/0115001 | A1* | 4/2019 | Ellingson | A63B 71/02 |
| 2019/0150213 | A1* | 5/2019 | Kim | H04L 41/08 370/254 |
| 2019/0361765 | A1* | 11/2019 | Alonso | G06F 11/0772 |

* cited by examiner

SYSTEM AND METHOD FOR COLLECTING DATA IN A LIVE SPORTING EVENT

BACKGROUND OF THE INVENTION

The present invention relates generally to sports timing systems, and more particularly, to systems and methods of collecting and analyzing real time data during basketball games.

Basketball at the college and professional levels is big business, and like any other industry it must remain relevant and legitimate in order to retain its customer base. Game officials such as referees play a very large role in preserving the authenticity of the game by making calls, maintaining order, and ensuring adherence to rules. This is no easy task given the impossibility of seeing everything, human error, and the very loud and emotionally charged environment where players, coaches and fans are quick to second guess and criticize.

Various systems and methods are commonly employed in basketball games in order to minimize some of the aforementioned challenges. Known systems and methods include utilizing multiple referees, instant replay, and camera-based hoop sensors. One improvement is a SPORTS MONITORING AND TRACKING SYSTEM described in U.S. Pat. No. 7,920,052 which issued Apr. 5, 2011 and pertains to specific signal generators, typically whistles, starting and stopping a game timer. This technology essentially negated the interference of background noise to allow specific game whistles to automatically activate the game timer. Another improvement is a SYSTEM FOR REMOTELY STARTING AND STOPPING A TIME CLOCK IN AN ENVIRONMENT HAVING A PLURALITY OF DISTINCT ACTIVATION SIGNALS described in U.S. Pat. No. 10,504,300 which issued Dec. 10, 2019 and pertains to starting and stopping a game clock with a variety of pre-identified whistles, and collecting data related thereto. This technology essentially improved the SPORTS MONITORING AND TRACKING SYSTEM invention by allowing referees to use their own whistles whose sonic fingerprints had been established, and collecting whistle blowing data on each referee based on those unique fingerprints. These references are incorporated by reference in their entirety.

The sum result of present technology is that a game clock can be triggered to automatically start or stop when game referees blow their whistle, with the timekeeper serving as a backup. This technology also records parameters such as who blew their whistle and when they blew it. This mined data can be analyzed, optionally alongside game footage, for quality control purposes such as establishing game clock adjustments and evaluating referee performance including reaction time and bias.

In spite of the advances in timing technology and data collection there are still many unmeasured but measurable variables that can influence the outcome of games, either unintentionally or purposely. For example, noise levels, temperature and humidity, ambient light, location of referee, and health conditions of referee are all variables that affect games. While it is possible to monitor these variables and others, an integrated system that measures and records these conditions in real time is not known. Contemporaneous or subsequent analysis of the resulting body of mined data is also not known.

As can be seen, there is a need for an improved system and method for collecting data in a live sporting event. It is desirable that this system and method provide an integrated means for collecting data related to timing, referee position and biometrics, scoring, and ambient conditions including temperature, humidity, noise and light. It is also desirable that the system facilitates communication between referees, time keepers and administrators, and that the means of communication can vary according to a preestablished protocol. It is also desirable that those using the system and method have various levels of access that allow them to view or change protocols, view data, and so forth.

SUMMARY OF THE INVENTION

A system and method of collecting data in a live sporting event includes a set of components used at a sporting event, for example a basketball game. Those components can include referee communication bundles, hoop sensors and a time clock, all communicatively coupled through a central base station. Referee communication bundles can include any combination of belt packs, microphone headsets and/or watches.

Multiple base stations at different locations, for example other basketball games, are communicatively coupled to at least one remote database accessible via a digital device having the appropriate application. A variety of data generated during a game, including environmental, biometrics of referees, communications and game-related information, are directed to and stored on the database for real time analysis and adjustments where appropriate, or for later review and analysis.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

The following structure numbers shall apply to the following structures among the various FIGS.:

10—Data collection system;
12—Game site;
13—Court;
14—Time clock;
15—Hoop;
16—Referee;
17—Headquarters;
20—Base station;
22—Official;
30—Whistle;
40—Referee communication bundle;
42—Belt pack;
43—Geo-sensor;
44—Biometric sensor;
45—Microphone headset;
47—Watch;

48—Whistle receiver;
50—Hoop sensor;
60—Database;
70—Digital device;
72—Application;
80—Signals;
81—Signal (watch to base station);
82—Signal (base station to time clock);
83—Signal (whistle to belt pack);
84—Signal (belt pack to base station);
86—Signal (hoop to base station);
87—Signal (administrator to database);
88—Signal (base station to database);
89—Signal (base station to administrator); and
90—Administrator.

As used herein, "game site" shall generally refer to a facility where a basketball game is held, including the court and ancillary areas such as courtside, stands, offices and locker room. "Official" shall refer generically to officiating persons including scorers, timekeepers and shot clock operators, while "referee" shall specifically refer to referees and umpires, and "administrator" shall refer to persons administrating the system, for example setting the protocols and monitoring the data. "Headquarters" shall refer to a location outside the game site, a "remote location" where at least one database is located, or if the database is not housed in an identifiable location, for example it is cloud-based, then "database" and "headquarters" are interchangeable terms. "Whistle" shall include any signaling device for game officiating such as whistles and other sound-generating devices. "Database" shall refer to a body of recorded data that is accessible, regardless of the storage medium. "Digital device" shall refer to devices including computers, tablets, phones and watches capable of communicating with at least one component of the present invention such as the base station, referee communication bundle, database or time clock. "Signals" shall refer to wired and/or wireless transmissions between various components, including cabled ethernet networking, WIFI networking, wireless (cell) networking and/or public band such as 900 Mhz, and may be unidirectional or bidirectional depending on the coupled components. "Application" can also include a conventional software-based program.

Figure 1:
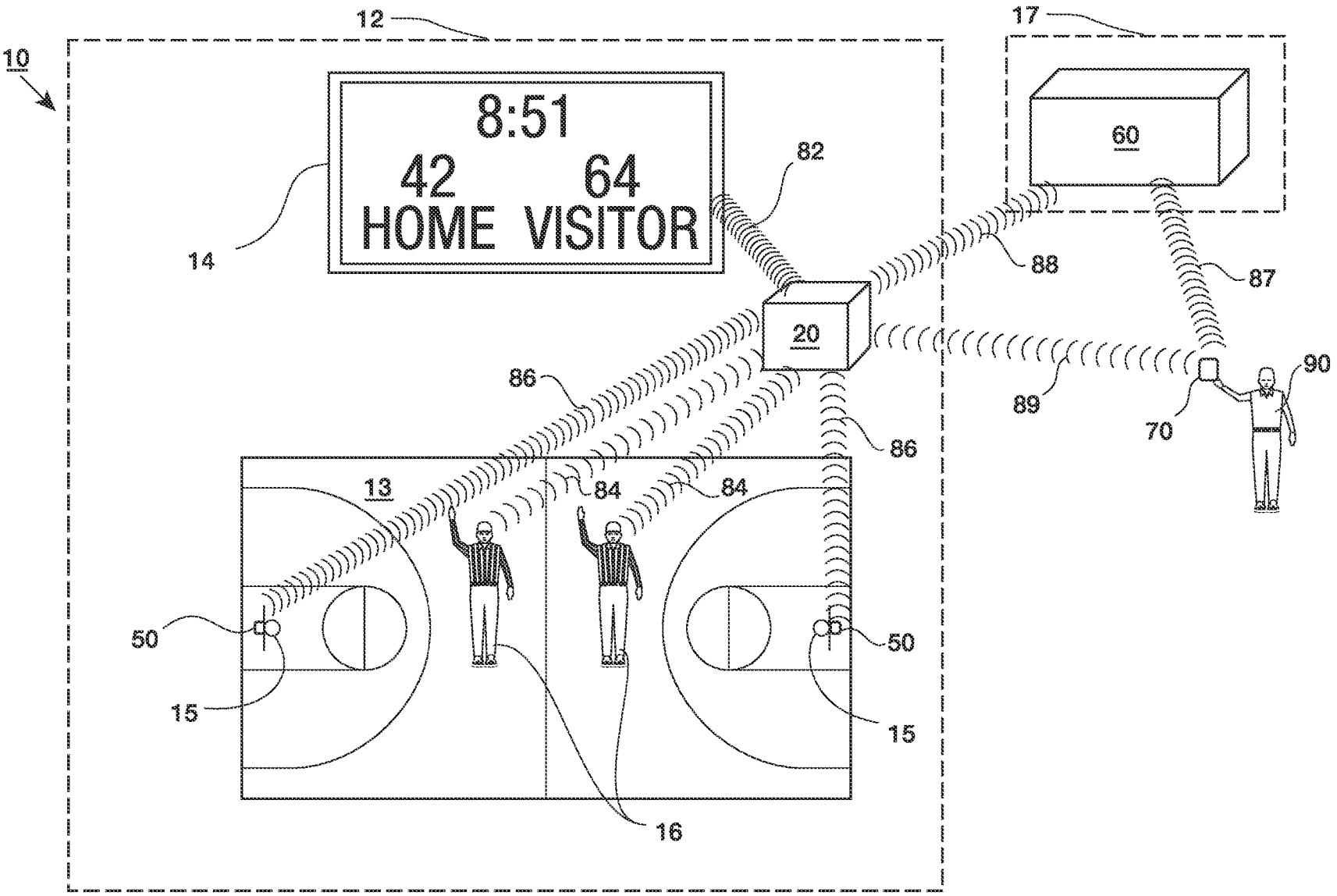
FIG. 1 depicts a single game site and some major components and data communication channels related thereto.

FIG. 1, depicts data collection system 10 at a single game site 12. In this preferred configuration two referees 16 on court 13 are each separately in communication with base station 20 via signal (belt pack to base station) 84, which is a bi-directional signal. Information transmitted from referee to base station can include signal for transmission to game clock to restart; voice or text-like communication to other referees, officials, timekeeper, administrator and/or management; game status; calling a player onto the court; interrupting another action happening on the court; geolocation; health conditions such as heart rate, blood pressure and/or body temperature; and/or RF noise on the floor. While some whistle blows are to effectuate a particular event, some whistle blows are more generally used to alert players, officials and timekeepers of a condition or circumstance that requires attention. Information transmitted from base station to referee can include voice or text-like communication from other referees, officials, timekeeper, administrator and/or management; game status; and environmental information such as ambient noise, temperature, humidity and/or ambient light.

Hoop sensor 50 sends unidirectional signal (hoop to base station) 86 to base station 20 when a basket is scored, thereby eliminating the need for a referee to make that determination. Each hoop sensor 50 is positioned on or near hoop 15, can optionally provide a stationary geolocation reference point for determining location of referees in conjunction with geo-sensor 43, and/or provide sensor(s) to monitor court conditions such as temperature and RF noise on the floor.

Base station 20 serves as a hub at each game site by receiving and/or sending signals between time clock 14, referees 16, and hoop sensors 50 as previously described. It preferably includes an internal power supply and battery backup. Additionally, base station is in bidirectional communication with database 60 via signal (base station to database) 88. Database is preferably located offsite at headquarters 17.

Administrator 90, who may be offsite, can communicate with base station 20 via signal (base station to administrator) 89, and/or communicate with database 60 via signal (administrator to database) 87. Administrator communications are preferably conducted through digital device 70, which is preferably loaded with application 72 (not shown).

Figure 2:
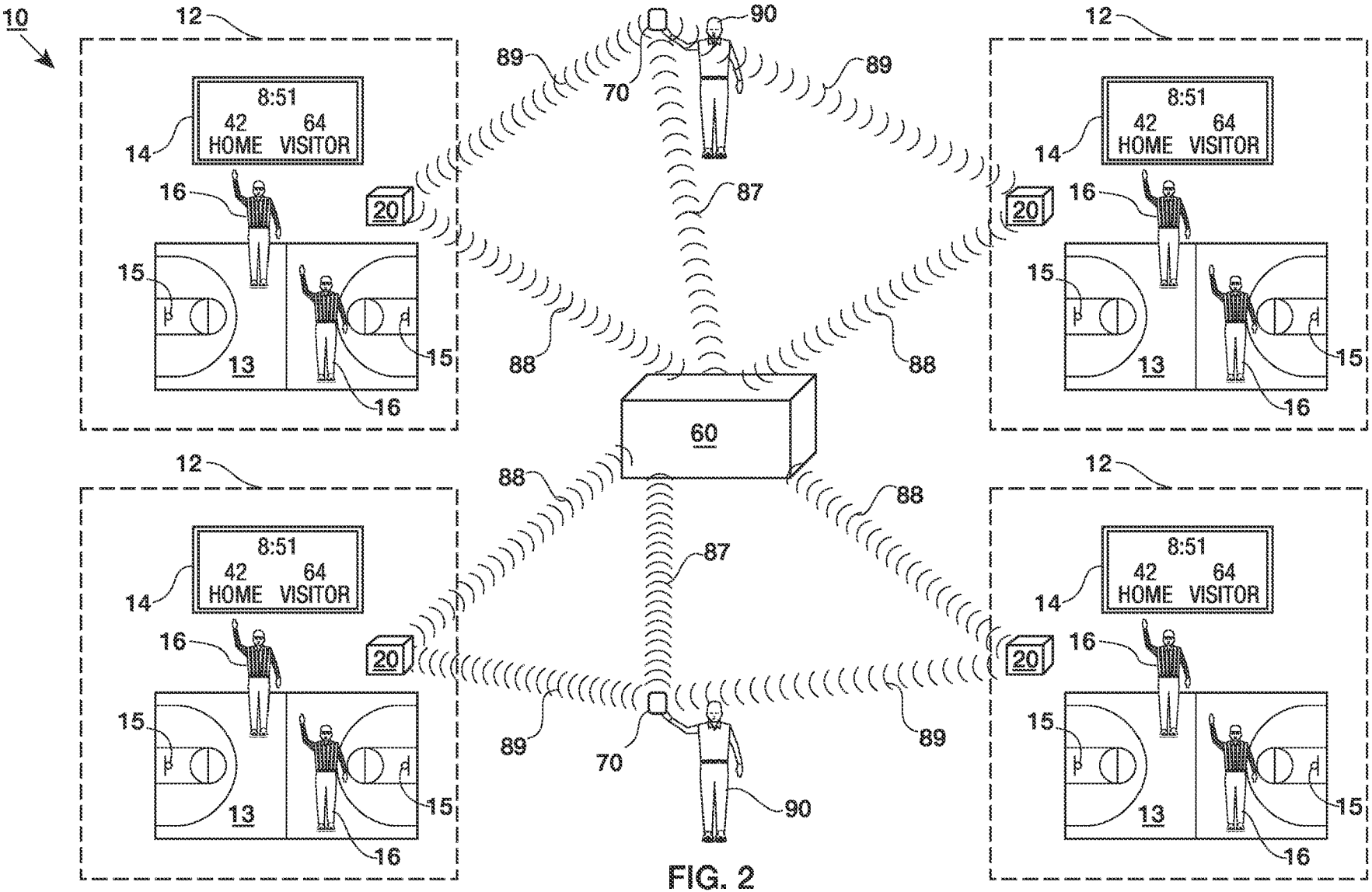
FIG. 2 depicts multiple game sites communicating with a central database.

While FIG. 1 focuses on the system at a single game site, FIG. 2 schematically depicts system 10 at multiple game sites simultaneously. Some details of FIG. 1 are omitted in FIG. 2 for clarity. As can be seen, base station 20 at each game site is in communication with database 60. This figure depicts two administrators 90 each having digital device 70, with each administrator in communication with two base stations 20 and a single central database 60. However, many variations of this arrangement fall within the scope of the invention. For example, there can be a single administrator or multiple administrators. Each administrator may have access to no base stations, to a single base station, or to a plurality of base stations. There may be one central database, or multiple databases, and each administrator may be in communication with none, all or some.

Not only is the system flexible with respect to which administrators have access to which components, for example time clock, base station and/or database, there are also varying administrator access levels. For example, a lower-level administrator may only be able to view certain data associated with certain game sites, while a higher-level administrator may be allowed to add comments to the time log.

It is difficult to understate the actual and potential value of the data collected by the present inventions. The data can be used to review referee decisions during a game, similar to instant replay. For example, data can definitively establish if a basket was scored with time remaining on the clock; can confirm which official or timekeeper started or stopped the clock either on purpose or by accident; and can establish whether another official had the same reaction but was not the first to make a call, thereby confirming a judgment.

In addition, data can be analyzed in countless ways, especially related to measuring referee quality and performance. For example, historical whistle blowing reaction time data could reveal a specific referee's intentional or unintentional bias towards a specific team. Also, a referee's biometric data could be correlated with geolocation data to determine if physical fatigue is affecting their ability to cover the court. Referees could be alerted if a certain biometric threshold is met.

Figure 3:
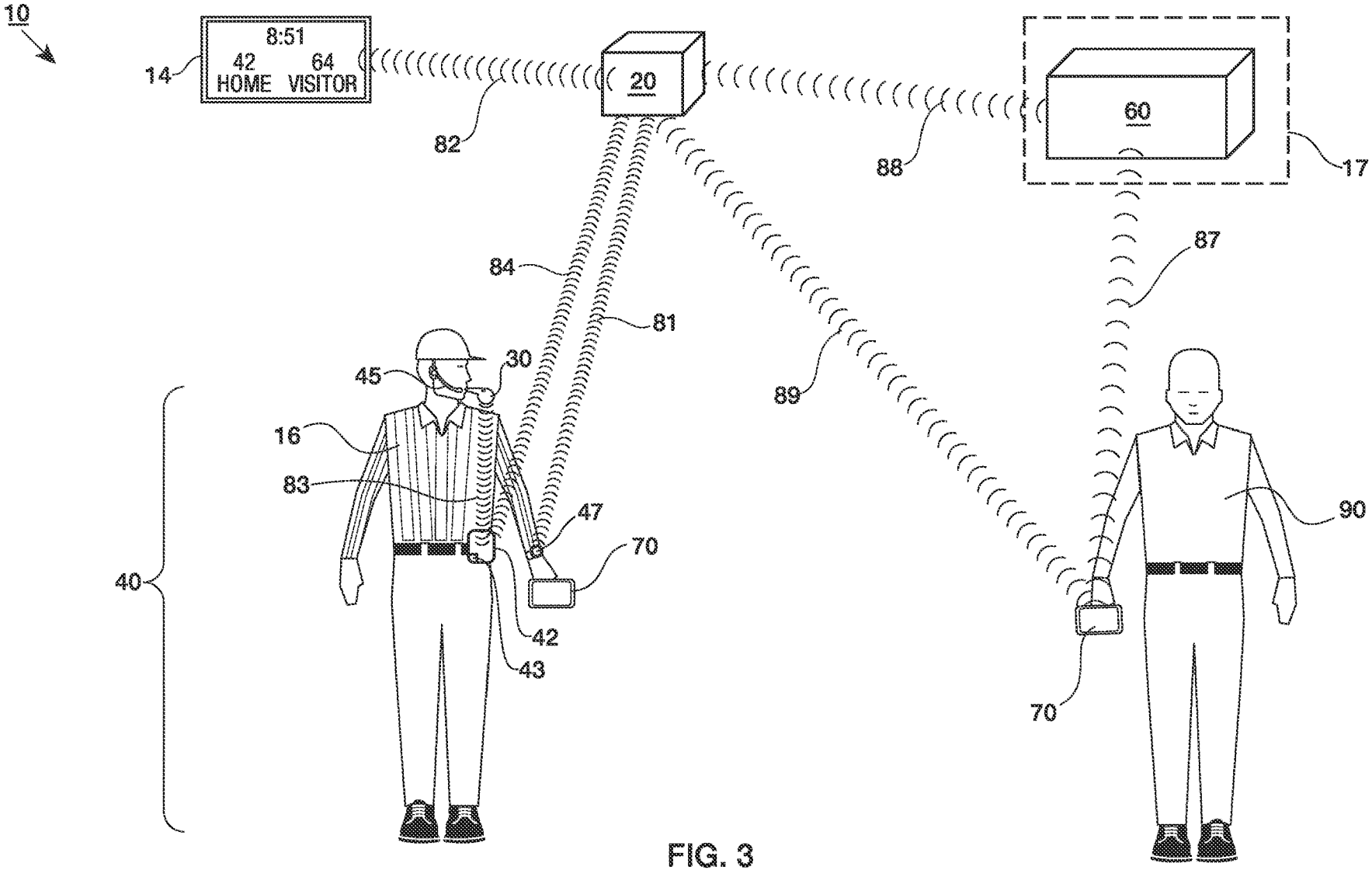
FIG. 3 depicts some data communication channels between a referee, an administrator, a base station and a database.

FIG. 3 depicts referee 16 and administrator 90 in communication with base station 20, time clock 14 and database 60, although the specific components each person is in communication with can vary according to their access, and the protocol employed.

In a preferred embodiment referee 16 is outfitted with whistle 30 of their choosing and referee communication bundle 40 which preferably includes belt pack 42, microphone headset 45 and watch 47. The belt pack preferably includes whistle receiver 48 (not shown) for receiving signal (whistle to belt pack) 83. If the sonic fingerprint of signal 83 matches the sonic fingerprint of the pre-recorded whistle sample, the belt pack sends signal (belt pack to base station) 84 to base station 20, which sends signal (base station to time clock) 82 to time clock 14, thereby triggering the time clock to stop or start.

The belt pack also preferably includes geo-sensor 43 for tracking the referee's location in real time. A variety of biometric sensors 44 (not shown) to measure vitals including referee's heart rate, temperature, pulse and sphincter rigidity are preferably coupled with the belt pack. Data feeding into belt pack travels via signal (belt pack to base station) 84 to base station 20, then via signal (base station to database) 88 to database 60. In a preferred embodiment the belt pack includes a button (not shown) for restarting the game clock.

Microphone headset 45 is preferably communicatively coupled with belt pack, with signals traveling along previously described signal (belt pack to base) 84 to base station 20 to signal (base station to database) 88 to database 60 path. This facilitates voice communication with other referees, timekeeper and/or administrator. Audio and/or microphone activation is determined by specific protocol, as these features may or may not be desirable or permittable in some games, but acceptable in others. The system may also be configured to provide notification when a communication has been received, which can be read at a later time. In a preferred embodiment all audio, both transmitted by and received by the referee, is recorded and archived.

In one embodiment referee wears watch 47, which is communicatively coupled with base station by signal (watch to base station) 81. This connection is preferably WIFI-based. Watch 47 may be configured to simply receive and display information, thereby serving as a "dummy terminal", or can function as a smart watch and facilitate simple two-way communication with base station. Examples of information include game time on clock, shot clock time on clock, and/or who blew last whistle. Information that can be measured include biometric, temperature, speed/tilt and altitude. Some functions and components herein described in connection with belt pack could alternatively be integrated with watch, and vice versa.

A variety of types of signal can be employed with embodiments of the present invention depending on the configuration of the system, the infrastructure in place at a given facility, the strength of interfering or desired signals, and other factors. In a preferred embodiment signal (watch to base station) 81 is WIFI, preferably 2.4 GHz or 5 GHz bands. Base station is preferably hardwired to time clock, but could also be communicatively coupled via signal (base station to time clock) 82, preferably using a 2.4 GHz band. Preferably signal (whistle to belt pack) 83 is sound waves; signal (belt pack to base station) 84 is 900 Mhz band; signal (hoop to base station) 86 is 900 Mhz; signal (administrator to database) 87 is WIFI networking or wireless (cell) networking; signal (base station to database) 88 is preferably cabled ethernet networking, but can also be WIFI networking or wireless networking; and signal (base station to administrator) 89 is WIFI networking or wireless networking.

In use, administrator 90 configures database 60 in accordance with a desired protocol to establish variables such as number of base stations, identity of teams and referees, and access levels of various officials and/or administrators. This configuration can be established via application 72 on digital device 70. At each game site 12 the system is configured to, for example, record sonic fingerprint of each referee's whistle, and ensure that hoop sensors and time clock are paired with base station. The system performs various functions during the basketball game as set forth herein, such as starting and stopping game clock in response to whistle blows and collecting biometric data on referees. Collected data, as well as communications, are sent in real time to database 60 where it is accessible and archived. Administrator(s) 90 are able to access real time and archived data remotely via application 72. Depending on access level, administrators may also be able to manipulate certain components, for example add time to a time clock, or send a communication to a game official.

It should be understood that the foregoing relates to exemplary embodiments of the invention and that modifications may be made without departing from the spirit and scope of the invention as set forth in the following claims. By way of example, referees may employ a digital device instead of, or in addition to, belt pack and/or watch. Also, while the system has been described in connection with basketball, it could easily be modified to work with other sports, particularly those having goals and defined playing spaces such as lacrosse, hockey and soccer. Terms such as "substantially" and the like shall mean within reasonable bounds when considering limitations such as machines, materials, manufacturing methods, and people. By way of example, a "substantially smooth" surface means there are no intentional bumps or irregularities. All ranges set forth herein include the endpoints as well as all increments there between, even if not specifically stated. By way of example 1 to 2 inches includes 1 inch, 1.000001 inches and so forth. Finally, unless otherwise stated or contrary to common sense, "approximate" and the like shall mean+/−10%.

What is claimed is:

1. A data collection system for a sporting event including:

A. A plurality of referee communication bundles each having referee actuated functionality, each referee communication bundle selected from the group consisting of a belt pack, a microphone headset, a watch and a mobile device, and each referee communication bundle including at least one biometric sensor, at least one whistle receiver, and at least one geo-sensor;

B. A base station communicatively coupled with said plurality of referee communication bundles; and C. A time clock communicatively coupled with said base station, wherein said time clock starts or stops in response to a first signal generated by one of said referee communication bundles.

2. The data collection system of claim 1 wherein said first signal is generated in response to one of said whistle receivers receiving an audio signal that substantially matches the sonic fingerprint of a pre-recorded audio signal.

3. The data collection system of claim 1 further including a database communicatively coupled with said base station.

4. The data collection system of claim 3 wherein said database is remotely located.

5. The data collection system of claim 4 wherein said database is accessible by a user through a mobile device having an application configured to provide access.

6. The data collection system of claim 5 wherein said application is configurable to provide varying levels of access to said database.

7. A data collection system for a plurality of basketball games including:

A. A plurality of referee communication bundles each having referee actuated functionality, each referee communication bundle selected from the group consisting of a belt pack, a microphone headset, a watch and a mobile device, and each referee communication bundle including at least one biometric sensor, at least one whistle receiver, and at least one geo-sensor;

B. A plurality of base stations communicatively coupled with said plurality of referee communication bundles;

C. A plurality of hoop sensors communicatively coupled with said base stations;

D. A plurality of time clocks communicatively coupled with said base stations; and E. At least one remote database communicatively coupled with said plurality of base stations.

8. The data collection system of claim 7 further including at least one digital device communicatively coupled with said database, said digital device configured to access data stored in said database.

9. The data collection system of claim 8 wherein said digital device is configured to add or subtract time from at least one of said time clocks.

10. The data collection system of claim 7 wherein said time clock starts or stops in response to a first signal generated by one of said referee communication bundles, and wherein said first signal is generated in response to one of said whistle receivers receiving an audio signal that substantially matches the sonic fingerprint of a pre-recorded audio signal.

11. A method of collecting data in a live sporting event including the non-sequential acts of:

A. Configuring a database to record data from a plurality of remote base stations;

B. Communicatively coupling said plurality of base stations with said database, each of said base stations located at a live sporting event;

C. Communicatively coupling a plurality of referee communication bundles with at least one of said plurality of base stations, each referee communication bundle having referee actuated functionality, each referee communication bundle selected from the group consisting of a belt pack, a microphone headset, a watch and a mobile device, and each referee communication bundle including at least one biometric sensor, at least one whistle receiver, and at least one geo-sensor;

D. Communicatively coupling a plurality of time clocks with at least one of said plurality of base stations; and E. Communicatively coupling a plurality of hoop sensors with at least one of said plurality of base stations.

12. The method of collecting data of claim 11 further including the non-sequential act of accessing said database with a digital device.

13. The method of collecting data of claim 11 wherein said act of configuring said database to record data includes the act of configuring said database to record data originating from said referee communication bundles, said time clocks and said hoop sensors.

* * * * *